US006810710B2

(12) United States Patent
Paoletti

(10) Patent No.: US 6,810,710 B2
(45) Date of Patent: Nov. 2, 2004

(54) ADJUSTABLE FORMING DIE, IN PARTICULAR FOR FORMING PRESSES

(75) Inventor: Fabrizio Paoletti, Agugliano (IT)

(73) Assignee: Angelo Romani S.p.A., Milan (IT); part interest ( * ) Notice: Subject to any disclaimer, the term of this patent is extended or adjusted under 35 U.S.C. 154(b) by 45 days.

(21) Appl. No.: 10/228,900

(22) Filed: Aug. 27, 2002

(65) Prior Publication Data

US 2003/0041642 A1 Mar. 6, 2003

(30) Foreign Application Priority Data

Aug. 29, 2001 (IT) ..... AN2001A0039 U

(51) Int. Cl.[7] ..... B21D 37/04; B21D 5/02
(52) U.S. Cl. ..... 72/389.4; 72/389.5
(58) Field of Search ..... 72/389.4, 389.5

(56) References Cited

U.S. PATENT DOCUMENTS 784,725 A * 3/1905 Yates ..... 72/389.4
4,106,323 A * 8/1978 Haenni et al. ..... 72/389.5
4,366,698 A * 1/1983 Gill ..... 72/389.4
4,367,644 A * 1/1983 Kramer et al. ..... 72/389.4
5,249,452 A * 10/1993 Baldwin et al. ..... 72/389.4
5,305,659 A 4/1994 Dieperink et al.
5,564,301 A 10/1996 Rönnmark

FOREIGN PATENT DOCUMENTS

EP 0 865 840 A1 9/1998
FR 2741288 5/1997

* cited by examiner

*Primary Examiner*—David B. Jones
(74) *Attorney, Agent, or Firm*—Pearne & Gordon LLP

(57) ABSTRACT

In a forming press, a die comprises a pair of half-dies, supported by a bed, able in turn to support an element to be deformed permanently in opposition to the thrust exerted by a forming punch. The die is provided, for each of the half-dies, with two racks associated to the respective half-die and to the bed, which are provided with at least a pair of oblique teeth, set side by side, and associated in mutual opposition with teeth of the one inserted between the teeth of the other. The teeth of the conjugate racks are mutually coupled simultaneously on at least two parallel and oblique contact planes, and mesh in a manner able to determine the variation of the distance between the half-dies in correspondence with the relative translation of the racks effected longitudinally to the half-dies themselves.

26 Claims, 1 Drawing Sheet

1
2
3
4
6
7b
10
11
13
15
16
17

2
3
7a
7b
8
9
18
19

ADJUSTABLE FORMING DIE, IN PARTICULAR FOR FORMING PRESSES

BACKGROUND OF THE INVENTION

The present invention relates to the mechanical forming of semi-finished metallic products such as plates, bars and other similar elements and, more specifically, it concerns an adjustable forming die, in particular for a forming press.

It is well known that presses for the mechanical forming of metallic elements comprise dies, supported by a bed, which are substantially "V" shaped and in turn able to support the element to be formed in opposition to the thrust that is exerted centrally to the element by a forming punch.

To change the distance between the bearing areas of the elements to be formed on the die, the prior art provides for dies in which two independent and movable half-dies can be positioned at a variable distance from each other to provide, in mutual combination, a bearing in which the "V" is more or less open depending on requirements.

Currently, the distance of the half-dies is adjusted through a system of mechanized wedges positioned between the half-dies and the bed. The wedges provide not only the capability of adjusting the distance, but also the ability to transmit to the bed the intense mechanical stresses exchanged between punch and die when the press is in use.

The wedges are positioned between parallel, vertical and opposite shoulders of the half-dies and of the bed; they work coupled with each other, reacting against said shoulders; and they are distributed at regular intervals longitudinally to the half-dies.

The angle of inclination of the wedges and of the corresponding counter-wedge of each pair is constructively limited to a few degrees. It is not possible to use wedges having inclinations greater than 7–8°, because said inclinations would render the mechanism reversible, and hence unusable.

In consideration of the above, to have a range of adjustment of the distance between the half-dies of acceptable amplitude, it is necessary to have rather long wedges available. Correlated to said length is also the minimum distance that, constructively, must separate the various pairs of wedges, that succeed each other longitudinally to the half-die of interest, to prevent mechanical interference during the adjustment of the distance between the half-dies.

As a consequence of the geometric and mechanical aspects described above, known dies are the result of a design compromise able to mediate different and mutually conflicting aspects. Said compromise cannot ignore an additional element represented by the fact that the very operation of a wedge and of a counter-wedge coupled therewith implies a continuous variation of the contact surface between wedge and counter-wedge. If the coupling surface reaches the minimum extension, between wedge and counter-wedge structural limits can be reached, connected with the reaching of excessive contact pressures for the local strength of the material constituting the wedges.

For the reasons set out above, prior art solutions therefore have practically insurmountable technical limits. To reach a pre-defined minimum distance between the half-dies, without having an insufficient contrast surface area between wedge and counter-wedge, it is necessary to build very long wedges. But very long wedges imply equally long intervals between the contiguous pairs of wedges that follow each other along the die; variable and large intervals, that in addition to influencing the longitudinal dimensions of the die, also influence the elastic deformability of the shoulders, implying in the die or in the press that uses it, deformations that in turn influence on one hand the construction of the die and of the press and on the other hand the precision of execution of the forming operation itself.

SUMMARY OF THE INVENTION

The aim of the present invention therefore is to overcome the characteristic limits of the forming dies used in known forming presses by means of a different and more advantageous mechanism for adjusting the distance of the half-dies and transmitting stresses between punch and die.

In accordance with the invention, said aim is achieved by a forming die, in particular for a forming press, comprising a pair of half-dies, supported by a bed, able in turn to support an element to be deformed permanently in opposition to the thrust exerted by a forming punch, comprising for at least one of said half-dies, two racks, respectively associated to the half-die and to the bed, provided with at least a pair of oblique teeth, set side by side, which racks are associated in mutual opposition with teeth of the one inserted between the teeth of the other, said teeth being correspondingly coupled on at least two parallel and oblique contact planes, mutually meshing in such a way as to vary the distance between the half-dies in correspondence with the relative translation of the racks effected longitudinally to the half-dies themselves.

The presence of at least two pairs of meshed teeth allows, retaining all other conditions equal with the systems used in prior art applications, to double the extension of the contact surface along which the teeth transmit the forces exchanged between punch and die.

However, if the racks are provided with multiple pairs of teeth, set mutually side by side, as many parallel contact surfaces as desired may be obtained.

This allows to obtain the total contact surface area of the extension best suited for one's own application, without thereby submitting to any geometric constraint related to the inclination of the teeth and to their longitudinal development.

If one then also causes the—single or multiple—pairs of teeth that follow each other longitudinally to the half-dies to have their teeth extended in such a way that their longitudinal projections are superposed, the reaction consequent to the loads exchanged between the teeth that is discharged on the shoulders of the bed or of the half-dies can be uniformly distributed over the length in such a way as to induce minor deformations of the parts under load: this benefits both the structural strength of the half-die or of the press that uses it, and the mechanical precision of the forming operation.

BRIEF DESCRIPTION OF THE DRAWINGS

The technical characteristics of the invention, according to the aforesaid aims, will be clear from the content of the claims set out below and its advantages shall become more readily apparent in the detailed description that follows, made with reference to the accompanying drawings, which show an embodiment provided purely by way of non limiting example, in which:

DESCRIPTION OF THE PREFERRED EMBODIMENTS

Figure 1:
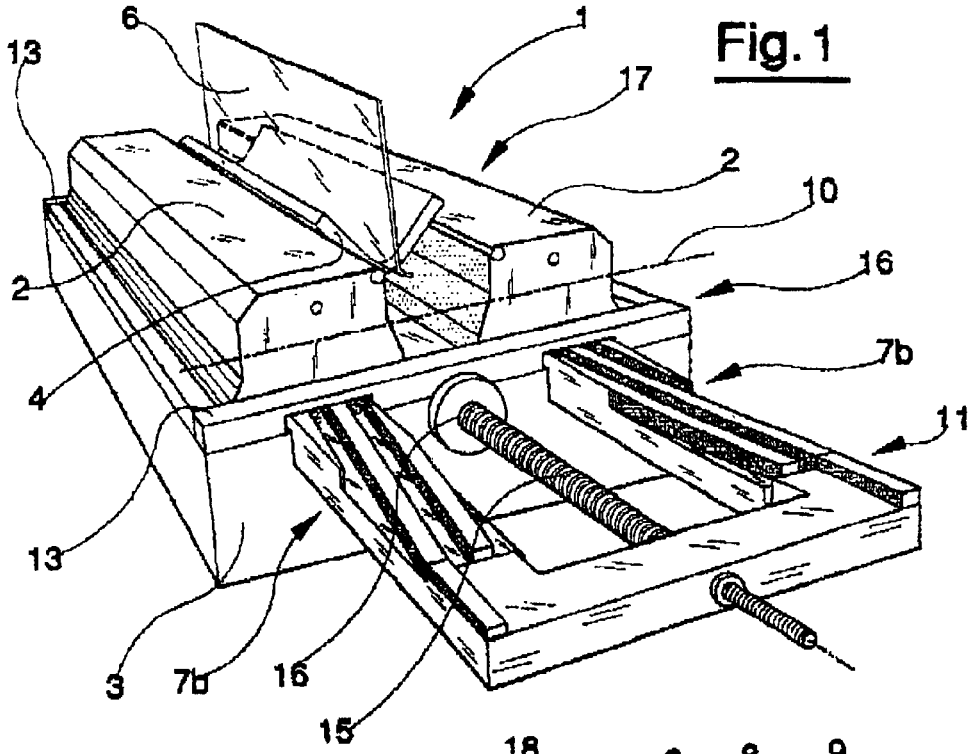
FIG. 1 is a global perspective view of a forming press according to the invention, shown schematically.

With reference to the accompanying drawings, FIG. 1 shows a forming press for forming metallic elements 4, generically represented by plates, bars or similar semi-finished products. The press, globally indicated as 1, essentially comprises, above a support bed 3, a forming die 17, "V" shaped and provided with a pair of half-dies 2, able to support an element 4 to be permanently deformed, in opposition to the thrust exerted by a forming punch 6.

Each of the half-dies 2 comprises two opposite racks 7*a*, 7*b* (FIG. 2), namely a first 7*a* and a second 7*b* rack respectively associated to the half-die 2 and to the bed 3, which are provided with pairs of oblique teeth 8, set mutually side by side.

The racks 7*a*, 7*b* are associated in mutual opposition and mesh with teeth 8 of the one inserted between the teeth 8 of the other and simultaneously coupled on one or more lateral contact planes 9, mutually parallel and oblique.

Figure 2:
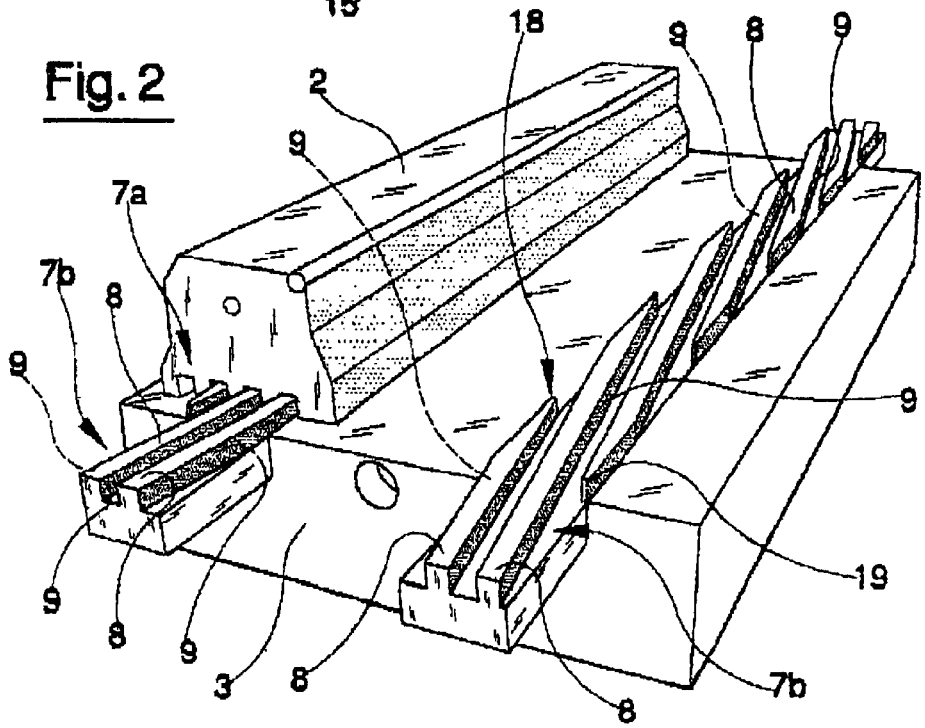
FIG. 2 is a perspective view of the forming press of FIG. 1, shown with some parts removed the better to highlight others.

The pairs of teeth 8 also follow each other, longitudinally to the half-dies 2, with partial superposition of the longitudinal projections of their teeth 8; this is readily apparent from FIG. 2, which shows that the terminal end 18 of a tooth 8 of a generic pair extends, longitudinally to the rack 7*b*, beyond the initial end 19 of the corresponding tooth 8 of the contiguous pair of teeth 8, that follows the pair in question.

FIG. 2 also shows that the racks 7*a*, 7*b* provide for the teeth 8 to be set mutually side by side in twos: but as shall become more readily apparent hereafter, such a configuration is to be considered wholly indicative and not limiting, so that, without departing from the same concept, the racks 7*a* and 7*b* can be obtained by appropriately setting mutually side by side also multiple ranks of pairs of oblique teeth 8 set mutually side by side.

The racks 7*b* associated to the bed 3 are borne unitarily by a first slide 11 which can be translated relative to the bed 3 longitudinally to the half-dies 2 by effect of actuating means that comprise, for instance, a screw-nut screw pair 15, 16 operatively interposed between the first slide 11 and the bed 3.

Superposed to the first slide 11 is located a second slide 16 able to allow the translation of the half-dies 2 along a movement trajectory that is orthogonal to the first slide 11.

Said second slide 16 comprises in particular a pair of guides 13 fastened to the bed 3, superiorly to the first sled 11. In abutment to the guides 13, each half-die 2 is able to be translated parallel to itself, sliding supported on the bed 3.

In use, following the translation of the first slide 11 relative to the bed 3 effected longitudinally to the half-dies 2 and by effect of the meshing of the racks 7*a* and 7*b*, the simultaneous translation of the half-dies 2 relative to the respective fixed guides 13 is produced, which translation, depending on the direction of motion of the first slide 11, causes the half-dies 2 to be moved correspondingly closer or farther away along a direction 10 of motion transverse to the dies, varying the relative distance between them in adjustable fashion.

The invention fully achieves the expected results with performance levels that are definitely superior to those of the prior art, both in terms of greater loading capacity of the die, and in terms of amplitude of regulation of the distance between the half-dies composing said die.

The solution described above also allows to obtain half-dies with limited dimensions in the longitudinal direction, and requires the use of a smaller number of component parts than does the prior art. This characteristic, together with the relative ease of construction of the invention, allows to obtain more reliable and relatively more economical constructive applications.

The invention thus conceived is suitable for evident industrial application; moreover, it can be subject to numerous modifications and variations, without thereby departing from the scope of the inventive concept that characterizes it. All components can be replaced by other technically equivalent elements.

What is claimed:

1. An adjustable forming die for a forming press, comprising:

a bed;

a pair of half-dies supported by the bed;

two opposite racks for at least one of said half-dies;

said two opposite racks presenting a first rack associated to the respective half-die and a second rack associated to the bed; each rack of said two racks being provided with at least a pair of oblique teeth set side by side; the first and second rack of said two racks being associated in mutual opposition with the teeth of the first rack inserted between the teeth of the second rack; the teeth of the first rack and the teeth of the second rack being correspondingly coupled on at least two parallel and oblique contact planes, to vary a distance between the half-dies along a direction of motion transverse to the half-dies upon a translation of the first rack relative to the second rack effected longitudinally said half-dies.

2. Die, as claimed in claim 1, wherein the teeth of said at least a pair of oblique teeth follow each other longitudinally to said half-dies with partial superposition of the longitudinal projections of said teeth.

3. Die, as claimed in claim 2, wherein each rack of said two racks comprises a plurality of pairs of oblique teeth set side by side.

4. Die, as claimed in claim 3, wherein the second rack associated to the bed is movable, relative to the bed, longitudinally to the half-dies and the first rack associated to the half die is movable in a transverse direction to said half-dies.

5. Die, as claimed in claim 4, comprising a first slide, movable longitudinally to the half-dies and integrally supporting the second rack, and a second slide superposed to the first slide and allowing the translation of the half-die orthogonally to said first slide and simultaneously to the relative motion of the two racks.

6. Die, as claimed in claim 5, wherein said second slide includes a pair of guides fastened to the bed over the first slide; the half-die being movable parallel to itself in abutment against said guides upon translation of the first slide.

7. Die, as claimed in claim 6, wherein said first slide supports two second racks associated to corresponding first racks of the half-dies; the die further comprising means for translating the first slide.

8. Die, as claimed in claim 7, wherein said actuating means comprise a screw and a nut screw operatively interposed between said first slide and said bed.

9. Die, as claimed in claim 2, wherein the second rack associated to the bed is movable relative to the bed, longitudinally to the half-dies and the first rack associated to the half die is movable in a transverse direction to said half-dies.

10. Die, as claimed in claim 9, comprising a first slide, movable longitudinally to the half-dies and integrally supporting the second rack, and a second slide superposed to the first slide and allowing the translation of the half-die orthogonally to said first slide and simultaneously to the relative motion of the two racks.

11. Die, as claimed in claim 10, wherein said second slide includes a pair of guides fastened to the bed over the first slide; the half-die being movable parallel to itself in abutment against said guides upon translation of the first slide.

12. Die, as claimed in claim 11, wherein said first slide supports two second racks associated to corresponding first racks of the half-dies; the die further comprising means for translating the first slide.

13. Die, as claimed in claim 12, wherein said actuating means comprise a screw and a nut screw operatively interposed between said first slide and said bed.

14. Die, as claimed in claim 1, wherein two opposite racks are associated to each of the half-dies.

15. Die, as claimed in claim 1, wherein each rack of said two racks comprises a plurality of pairs of oblique teeth set side by side.

16. Die, as claimed in claim 15, wherein the second rack associated to the bed is movable, relative to the bed, longitudinally to the half-dies and the first rack associated to the half die is movable in a transverse direction to said half-dies.

17. Die, as claimed in claim 16, comprising a first slide, movable longitudinally to the half-dies and integrally supporting the second rack, and a second slide superposed to the first slide and allowing the translation of the half-die orthogonally to said first slide and simultaneously to the relative motion of the two racks.

18. Die, as claimed in claim 17, wherein said second slide includes a pair of guides fastened to the bed over the first slide; the half-die being movable parallel to itself in abutment against said guides upon translation of the first slide.

19. Die, as claimed in claim 18, wherein said first slide supports two second racks associated to corresponding first racks of the half-dies; the die further comprising means for translating the first slide.

20. Die, as claimed in claim 19, wherein said actuating means comprise a screw and a nut screw operatively interposed between said first slide and said bed.

21. Die, as claimed in claim 1, wherein the second rack associated to the bed is movable relative to the bed, longitudinally to the half-dies and the first rack associated to the half die is movable in a transverse direction to said half-dies.

22. Die, as claimed in claim 21, comprising a first slide, movable longitudinally to the half-dies and integrally supporting the second rack, and a second slide superposed to the first slide and allowing the translation of the half-die orthogonally to said first slide and simultaneously to the relative motion of the two racks.

23. Die, as claimed in claim 22, wherein said second slide includes a pair of guides fastened to the bed over the first slide; the half-die being movable parallel to itself in abutment against said guides upon translation of the first slide.

24. Die, as claimed in claim 23, wherein said first slide supports two second racks associated to corresponding first racks of the half-dies; the die further comprising means for translating the first slide.

25. Die, as claimed in claim 24, wherein said actuating means comprise a screw and a nut screw operatively interposed between said first slide and said bed.

26. Forming press, comprising:

a forming punch; and an adjustable forming die comprising a bed, a pair of half-dies supported by the bed, to support an element to be permanently deformed in opposition to a thrust exerted by the forming punch, and two opposite racks for at least one of said half-dies; said two opposite racks presenting a first rack associated to the respective half-die and a second rack associated to the bed; each rack of said two racks being provided with at least a pair of oblique teeth set side by side; the first and second rack of said two racks being associated in mutual opposition with the teeth of the first rack inserted, between the teeth of the second rack; the teeth of the first rack and the teeth of the second rack being correspondingly coupled on at least two parallel and oblique contact planes, to vary a distance between the half-dies along a direction of motion transverse to the half-dies upon a translation of the first rack relative to the second rack effected longitudinally to said half-dies.

* * * * *

UNITED STATES PATENT AND TRADEMARK OFFICE

CERTIFICATE OF CORRECTION

PATENT NO. : 6,810,710 B2
DATED : November 2, 2004
INVENTOR(S) : Fabrizlo Paoletti It is certified that error appears in the above-identified patent and that said Letters Patent is hereby corrected as shown below:

Column 4,
Line 25, after "longitudinally", please insert -- to --.
Line 55, after "movable", please insert -- , --.

Column 5,
Line 35, after "movable", please insert -- , --.

Column 6,
Line 30, after "inserted", please delete ",".

Signed and Sealed this

Sixteenth Day of August, 2005

JON W. DUDAS
*Director of the United States Patent and Trademark Office*